US006241924B1

(12) United States Patent
Witter et al.

(10) Patent No.: US 6,241,924 B1
(45) Date of Patent: Jun. 5, 2001

(54) METHOD FOR INVERTING THE CONVEX CONFIGURATION OF A LIQUID-PRODUCT STORAGE-TANK BOTTOM BY APPLYING HARDENABLE MATERIAL HAVING PLASTIC PROPERTIES

(75) Inventors: Aldyr Witter, deceased, late of São Leopoldo, by Roger Vieira Witter, legal representative; Luis Adolfo Velloso Pradel, Porto Alegre, both of (BR)

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 09/174,172

(22) Filed: Oct. 16, 1998

(30) Foreign Application Priority Data

Oct. 17, 1997 (BR) ..... 9705077

(51) Int. Cl.[7] ..... B29C 39/10

(52) U.S. Cl. ..... 264/32; 264/36.15; 264/269; 264/35

(58) Field of Search ..... 264/32, 35, 259, 264/265, 269, 36.15, 36.16; 156/94, 98

(56) References Cited

U.S. PATENT DOCUMENTS 1,512,557 * 10/1924 Mills .
2,903,877 * 9/1959 Meade ..... 264/35
3,340,126 * 9/1967 Knight ..... 264/32
3,742,866 * 7/1973 Needham et al. .
4,406,471 * 9/1983 Holloway .
4,457,332 7/1984 Hoshino et al. .

FOREIGN PATENT DOCUMENTS 9 100 874 12/1991 (NL) .
98 04479 2/1998 (WO) .

* cited by examiner

*Primary Examiner*—Mathieu D. Vargot
(74) *Attorney, Agent, or Firm*—Nixon & Vanderhye PC

(57) ABSTRACT

A method for inverting the convex configuration of a liquid-product storage-tank bottom is described for providing greater efficiency in the removal of undesirable materials that normally accumulate on the tank bottom. A layer of material having plastic properties is placed over the conventional tank bottom except for at least one section from the center of the tank base to the edge. The material with plastic properties hardens over time, thus producing a new bottom having a center at a level below the level of the edge. The part over which the material having plastic properties was not placed forms a flow gutter which leads the liquids and sediments which have to be drained off to the edge.

14 Claims, 3 Drawing Sheets

FIG. 3a
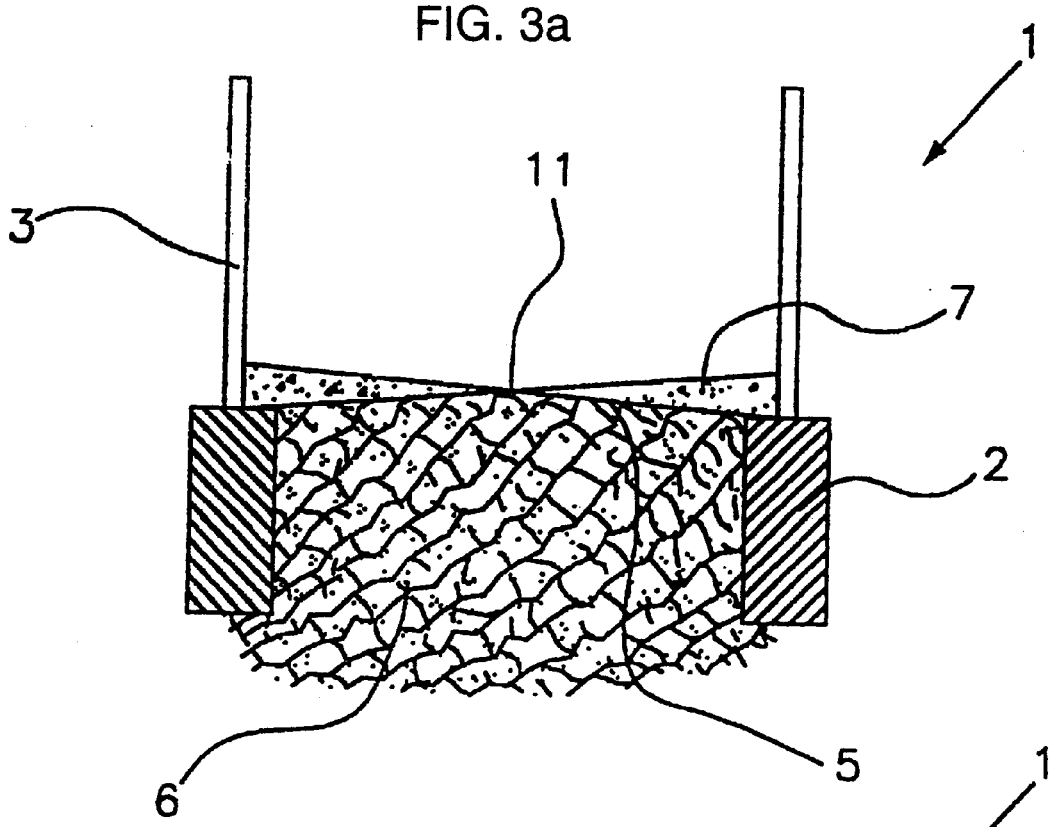
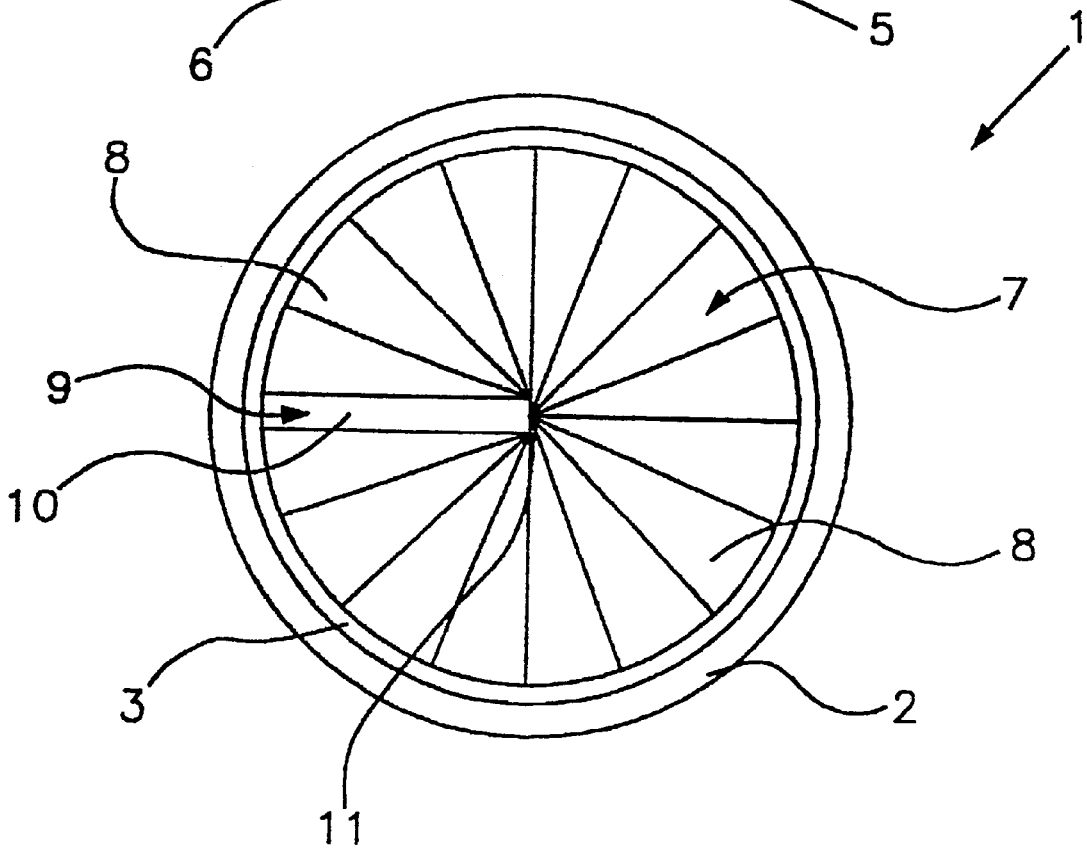
FIG. 3b

METHOD FOR INVERTING THE CONVEX CONFIGURATION OF A LIQUID-PRODUCT STORAGE-TANK BOTTOM BY APPLYING HARDENABLE MATERIAL HAVING PLASTIC PROPERTIES

FIELD OF THE INVENTION

This invention relates to a method for inverting the convex configuration of the bottom of a tank intended for the storage of liquid products, specifically petroleum and its derivatives, and is intended to provide a more effective shape to promote flow of the undesirable liquids and sediments which normally accumulate there. It is particularly applicable to large capacity tanks.

PRIOR ART

Storage tanks are widely used in the oil industry and are essential to the functioning of an operational unit. They may be intended for the storage of e.g. crude oil, intermediate products or final products.

During product storage it is normal for there to appear undesirable liquids and sediments which might have accompanied the product when it was placed in the tank. The undesirable liquids and sediments (dense residues, sludges, water, sand, etc.) are generally heavier than the product stored, and because of this they tend to deposit out at the bottom of a tank.

The storage tanks currently in use, especially those of medium and large capacity, have a side wall of cylindrical shape mounted on a foundation ring. The bottom is generally in the shape of a dome or cone, with the convex part pointing upwards.

Cleaning ports and inspection ports are provided in the lower part of the cylindrical side wall. The cleaning ports have hatches which are located on the side wall, supported on the foundation ring. This location enables the cleaning port to be used to monitor the level of the undesirable liquids deposited in the bottom of the tank.

This monitoring is performed using a liquid level indicator placed on the hatch of the cleaning port. The level indicator is used to inform an operator when it necessary to drain a tank to remove the undesirable liquids and sediments or when it is necessary to stop drainage, so as to prevent the stored product being inadvertently drained off.

Various drainage pipes are located at the lower part of a tank in order to permit the undesirable liquids and sediments to pass outside the storage tanks. At the outlet from each drainage pipe there is a shut-off valve which, when open, allows the undesirable liquids and is sediments to flow out of the tank.

Commonly, mixers are installed within the tank to homogenize the stored product. The number of mixers depends on the storage capacity and the type of product stored.

The mixers have the disadvantage that they also cause the undesirable liquids and sediments to move towards the center concave bottom of the tank, away from the drainage ports, which makes it more difficult to cause these undesirable liquids and sediments to flow outside the tank.

As the bottoms of tanks currently in use generally have a center at a higher level than their edge, there is a tendency for the undesirable liquids and sediments to accumulate at the edge, forming an annular layer. However, because the edge of the tank is at a uniform level and there is no difference in level to encourage these undesirable liquids and sediments to drain off through the drainage pipes, flow is slow, and this encourages the undesirable liquids and sediments to accumulate at the bottoms of the tanks, mainly in the areas furthest from the drains.

WO-A-98/04479 discloses an improvement for liquid product storage tanks, especially those of large capacity, which solves the problems described above, and comprises inverting the convex configuration of the bottom into a conical configuration, with the center of the tank bottom at a level lower than the level of the edges.

A drainage gutter runs from the center of the tank bottom to the edge, with a sufficient gradient to encourage flow of the undesirable liquids and sediments to the edge of the tank, from where they can be easily drained off to a location outside the tank.

This improvement can easily be applied to the construction of new tanks, since it is easy to get the drainage gutter for undesirable residues to reach the level of the threshold of a cleaning port, immediately above the foundation ring, while at the same time maintaining a gradient in the drainage gutter or channel which encourages the flow of undesirable liquids and sediments to the edge of the tank.

However, when the same principle of inverting the base is applied to an existing tank various difficulties are encountered. If for example the edge of the tank bottom is kept at the level of the foundation ring, it will be seen that the drainage gutters reach the side edges of the tank at a level below the top of the foundation ring, which makes it necessary to make openings in the foundation ring in order to allow flow through the drainage pipes, which implies the need to revise the structural design in order to check the strength of the ring. It may even be necessary to adopt new structural solutions.

In order to change the convex configuration of the bottom of an existing tank so that the drainage gutter ends precisely at the threshold of the inspection port, the edges of the bottom must be at a level higher than the level of the top of the foundation ring. This change makes it necessary to revise the structural design of the tank and also to raise the level of the base supporting the bottom of the tank, which makes the cost of the alteration quite expensive.

It should also be mentioned that the alternatives described above are not envisaged in the petroleum industry standard API 650 which governs the construction of tanks.

OBJECT OF THE INVENTION

It is an object of this invention to provide a method of modifying an existing liquid storage tank so as to improve the efficiency in the operation of draining off the undesirable liquids and sediments which normally accumulate at the bottom of a storage tank.

It is a further object of the invention to provide a simple method of modifying a tank bottom to improve the drainage of such undesirable liquids and sediments.

SUMMARY OF THE INVENTION

The present invention provides a method for inverting the upwardly convex configuration of the bottom of a liquid-product storage tank having at least one cleaning port by applying a material having plastic properties, characterized in that it comprises the following stages:

first arranging on the bottom a plurality of containment formwork units distributed over the surface of the bottom, except in at least one section extending from the center of the tank bottom to its periphery opposite a said cleaning port, which units form containment areas for the placing of material having plastic properties;

then placing in the containment areas formed by the containment formwork a material having plastic properties which hardens over time and which has dimensions such that, other than in said at least one section extending from the tank bottom center to its periphery, the quantity of said hardenable plastic material which has to be placed in the containment areas increases with increasing radial distance from the center of the conventional bottom; and converting said at least one section into a drainage gutter which has a ramp whose gradient is sufficient to encourage flow of the undesirable liquids and sediments to the region, opposite the cleaning port from which they can more easily be drained off.

This method provides a low-cost and simply-applied method which can be used to invert the concave configuration of an existing tank having a conventional bottom without the need to remove the bottom, simply by depositing over the conventional bottom a material having plastic properties, which hardens over time.

Using this method the original conventional bottom continues to meet the existing standards, any small imperfections in their surface resulting from the process of construction are corrected, and any small leaks which may be occurring are stopped, thus also preventing corrosion and the consequent contamination of groundwater.

This method can also be used when constructing new tanks, in that the bottom may be constructed in accordance with current standards, and then its convex configuration may be inverted by the subsequent application of a material having plastic properties which hardens over time.

The layer of a material having plastic properties, which hardens over time, may be placed over the surface of the tank bottom using containment form work.

It confers on the bottom, a concave shape providing a single central point for the collection of undesirable liquids and sediments, that is a convergence point for drainage.

The undesirable liquids and sediments which accumulate in the center of the bottom flow out through at least one inclined drainage gutter which starts at the central collection point in the middle of the bottom and ends at the periphery of the tank bottom, at a level below the center of the tank bottom, and has a sufficient gradient to enable the undesirable liquids and sediments to flow out of the tank.

The bottom of the tank may first be coated with a layer of sealant resin, e.g. polyurethane resin, before application of the material having plastic properties.

Likewise a layer of sealant resin may be placed on the layer of material having plastic properties, after it has hardened, particularly at junction points, in order to improve the seal at those points.

BRIEF DESCRIPTION OF THE DRAWINGS

The characteristics of this new method will be better understood from the following detailed description, provided merely by way of example, of one possible embodiment of the invention, taken in conjunction with the drawings mentioned below, which form an integral part of this description. In the drawings:

FIG. 3*a* in a cross-sectional view and FIG. 3*b* is a top plan view of the storage tank of FIG. 2 showing a layer of material with plastic properties which has already hardened applied to the bottom of the tank.

DESCRIPTION OF A PREFERRED EMBODIMENT

Figure 1:
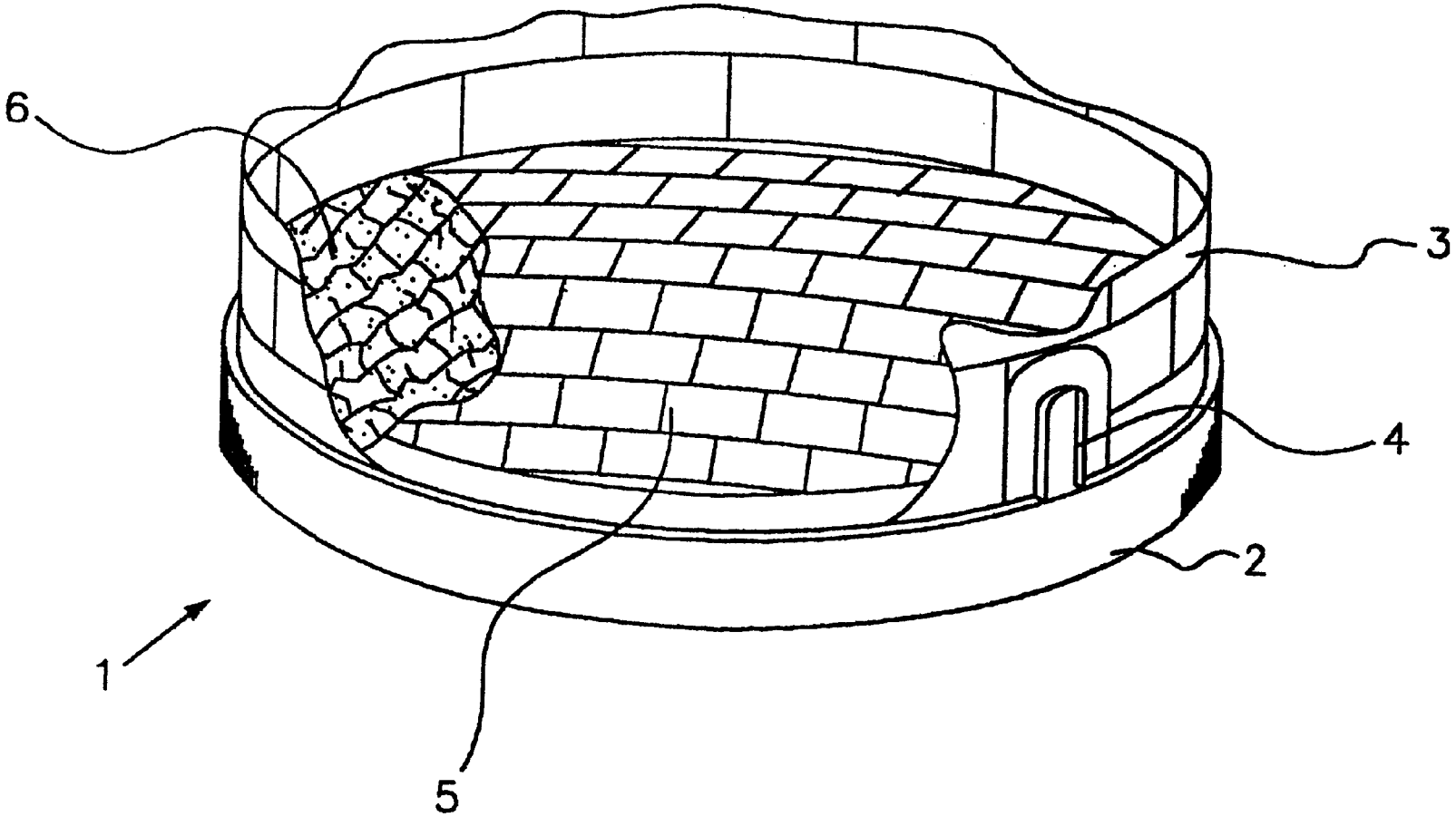
FIG. 1 is a perspective view of a prior art liquid product storage tank.

FIG. 1 shows a perspective view of a tank (1) for the storage of liquid products. A foundation ring (2) serves as a base to support a cylindrical side wall (3), which forms the wall of the tank (1).

At least one cleaning port (4) is provided in side wall (3), immediately above foundation ring (2) to provide access to the interior of tank (1) and for allowing the undesirable liquids and sediments contained in it to flow out.

A conventional bottom (5), of convex shape, which is linked to the lower part of the inside face of the side wall (3) and which is supported on an area of compacted ground (6) contained within the foundation ring (2), can be seen at the lower part of tank (1).

The method for inverting the concave configuration of the conventional bottom (5) of the liquid storage tank (1) will now be described in detail.

The basic principle used in the method is the application over the conventional tank bottom (5) of a material having plastic properties and configured so that the new edges of the bottom are raised to a level which is conveniently higher than the level of the center of the new bottom. The material having plastic properties solidifies after a period of time and thus produces a new bottom with a concave configuration, similar to that described in above mentioned WO-A-98/04479.

In order to obtain the drainage gutter mentioned in WO-A-98/04479 it is sufficient to avoid or reduce the deposition of the material having plastic properties in a segment having a shape equivalent to that of a drainage gutter. By proceeding in this way a small part of the conventional bottom (5) acts as the inclined drainage gutter, as will be seen more clearly below.

Merely by way of example, in this description the material having plastic properties and which is placed over conventional bottom (5) is a mortar, preferably concrete. Merely for the purposes of simplifying the, description, only the term hardenable plastic material will be used hereinafter to refer to either concrete particular or the material having plastic properties, in general, and thus the various references to both the material in general and to mortar should be regarded as being equivalent. This cannot however be regarded as any limitation on the method now being described and in implementing the method it is possible to use any other material having properties similar to concrete.

Figure 2:
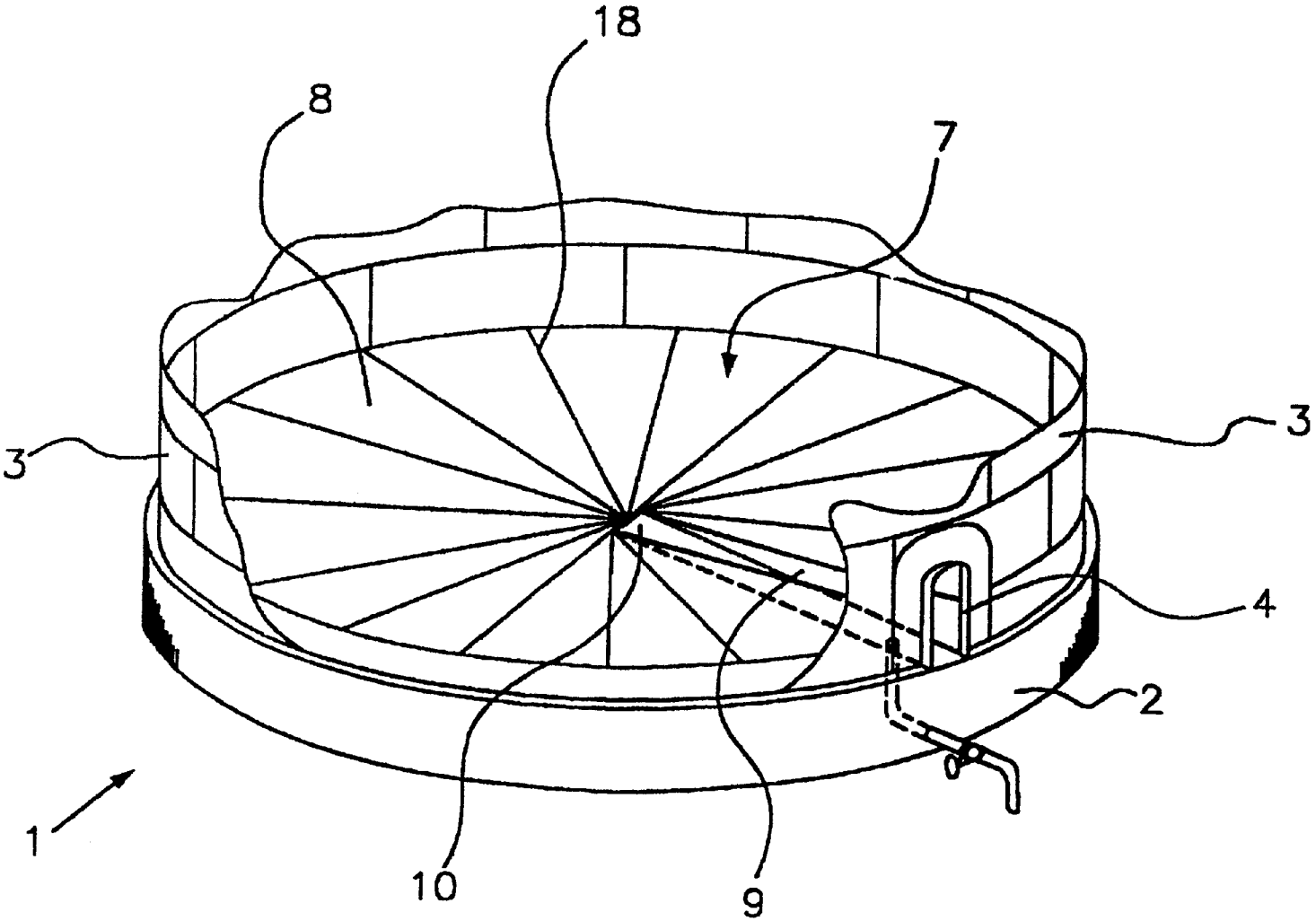
FIG. 2 is a perspective view of the liquid-product storage tank of FIG. 1 which has been modified in that a layer of material having plastic properties, which has already hardened, has been applied in segments to the bottom of the tank.

FIG. 2 shows the bottom (7) resulting from the placing of concrete over the conventional bottom (5) set out in the form of radial segments (8) with the help of containment formwork (18). It should be pointed out that the radial distribution of the formwork is only one of many possibilities, and should not be regarded as limiting this method.

A procedure for placing material having plastic properties on the conventional tank bottom (5) is described below.

Initially a plurality of items of containment formwork (18), which is appropriately distributed and is manufactured of appropriate material, is placed on the conventional bottom (5) so as to bound containment areas for emplacement of the concrete. This containment formwork (18) is of a size such that the quantity of concrete which has to be placed in the containment areas will increase with increasing radial distance from the center of the conventional bottom (5) so that the periphery of the new bottom will be at a level higher than the level of the center, as may be seen in FIG. 3*a*.

The containment formwork (18) is distributed over the entire, surface of conventional bottom (5) except in at least one radial strip of the conventional bottom (5), in front of a cleaning port (4), where no concrete is placed.

Concrete is then placed in the containment areas formed by the containment formwork (18) other than said at least one radial strip, using any known technique as will be widely known to those skilled in the art; such application technique will not be described here as it does not form an integral part of this method.

After the concrete has been placed in the containment areas formed by the containment formwork (18) and after the concrete has fully set, a new bottom (7) with a concave configuration is obtained.

The region in which no concrete was placed becomes a drainage gutter (9) which has an inclined floor in the form of a ramp (10) comprising a part of the conventional bottom (5) whose gradient is sufficient to cause the undesirable liquids and sediments to flow outwardly to the region alongside cleaning port (4), from which they can more easily be removed. The side walls of the drainage gutter (9) are the walls of the containment formwork (18) or, if these have been removed, of the concrete itself. The drainage gutter (9) can be protected by an appropriate material coating its side walls and ramp (10), as will be seen below.

If desired, the ramp (10) may be formed by applying to the conventional bottom (5) a tapering layer of the hardenable material having plastic properties, so as to modify the angle of inclination of the bottom of the gutter (9) to differ from the angle of inclination of the original tank bottom (5).

FIG. 3*a* shows a cross-sectional view of the, storage tank in FIG. 2, showing a layer of hardened concrete placed on conventional bottom (5) of the tank (1) to form a new bottom (7) with a concave configuration, whose center (11) lies at a level lower than the level of the periphery of new bottom (7). Drainage gutter (9) with its ramp (10) can be seen, and in this, as discussed above, the ramp (10) is a part of the conventional bottom (5) on which concrete has not is been placed. This modified tank is shown in top plan view in FIG. 3*b*.

It should be pointed out that the material having plastic properties which is placed on conventional bottom (5) must have properties such as to ensure that the new bottom (7) is leakproof with respect to the liquid which will be stored.

The conventional tank bottom (5) may be coated with a layer of sealing material, for example polyurethane resin, before application of the material having plastic properties, in order to ensure that it is leakproof. If not all of the conventional bottom (5) is coated with sealing material before application of the material having plastic properties, it is then to be recommended, that at least the part of the conventional bottom (5) which forms the ramp (10) should be coated with a sealing material.

Likewise a layer of sealing material may be applied either to the entire surface of the layer of material having plastic properties after it has hardened, or alternatively only to the joints in order to improve the seal in these areas.

In order to achieve a further improvement in the quality of the coating of the junction areas, the containment formwork (18) may be constructed so that a small portion of its upper part, at the surface of the layer of material having plastic properties, can be removed after that material has hardened. In this way a quantity of sealing material can be placed within the resulting gaps which form between the hardened layers of material having plastic properties, which guarantees prevention of impregnation, by the stored liquid product, of the material of the embedded containment formwork (18) which is generally made of wood or a similar material.

The method described above thus provides an easy, is convenient and secure method tor inverting the convex configuration of the bottom of a storage tank for liquid product, which provides better drainage of the undesirable liquids and sediments which accumulate at the bottom of such a tank.

What is claimed is:

1. Method for inverting the upwardly convex configuration of the bottom of a liquid-product storage tank having at least one cleaning port, by applying a material having plastic properties, comprising the following steps:

first arranging on the bottom a plurality of containment formwork units distributed over the surface of the bottom except in at least one section extending from the center of the tank bottom to its periphery adjacent a said cleaning port, which units form containment areas for the placing of material having plastic properties;

then placing in the containment areas formed by the containment formwork a material having plastic properties which hardens over time and which has dimensions such that, other than in said at least one section extending from the tank bottom center to its periphery, the quantity of said hardenable plastic material which has to be placed in the containment areas increases with increasing radial distance from the center of the bottom; and converting said at least one section into a drainage gutter which has a ramp whose gradient is sufficient to encourage flow of the undesirable liquids and sediments to the cleaning port from which they can more easily be drained off.

2. Method according to claim 1, characterized in that the containment formwork extends radially over the bottom of the liquid-product storage tank.

3. Method according to claim 1, characterized in that the bottom is coated with a layer of sealing material.

4. Method according to claim 1, characterized in that none of the hardenable plastic material is applied to said at least one section extending from the center of the tank bottom to its periphery adjacent said cleaning port.

5. Method according to claim 4, characterized by the step of applying a coating of sealing material to the part of the bottom which forms the ramp.

6. Method according to claim 1, characterized by the step of applying said hardenable plastic material to said at least one section extending from the center of the tank bottom to its periphery, in a configuration such that the surface of the hardened material in said at least one section is inclined downwardly from the center of the tank bottom towards the tank periphery with an inclination which differs from that of the tank bottom before conversion.

7. Method according to claim 6, characterized by the step of applying a coating of sealing material to the surface of said hardened material in said at least one section.

8. Method according to claim 1, characterized in that the containment formwork is constructed such that part of the top which is at the level of the surface of the layer of the hardenable plastic material can be removed after the applied material has hardened; and in that sealing material is applied to the interior of the gaps formed between the adjacent bodies of the already-hardened plastic material.

9. Method according to claim 1, characterized by coating with a sealing material the surface formed by the application of hardenable plastic material, the side walls of said drainage gutter and the pan of the bottom forming the ramp, of the drainage gutter.

10. Method according to claim 3, characterized in that none of the hardenable plastic material is applied to said at least one section extending from the center of the tank bottom to its periphery opposite the cleaning port.

11. Method according to claim 10, characterized by the step of applying a coating of sealing material to the pan of the bottom which forms the ramp.

12. Method according to claim 3, characterized by the step of applying said hardenable plastic material to said at least one section extending from the center of the tank bottom to its periphery, in a configuration such that the surface of the hardened material in said at least one section is inclined downwardly from the center of the tank bottom towards the tank periphery with an inclination which differs from that of the tank bottom before conversion.

13. Method according to claim 12, characterized by the step of applying a coating of sealing material to the surface of said hardened material in said at least one section.

14. Method according to claim 1, characterized in that the containment formwork is constructed such that part of the top which is at the level of the surface of the layer of the hardenable plastic material can be removed after the applied material has hardened; and in that sealing material is applied to the interior of the gaps formed between the adjacent bodies of the already-hardened plastic material.

* * * * *